US006942583B2

(12) United States Patent
Syu

(10) Patent No.: US 6,942,583 B2
(45) Date of Patent: Sep. 13, 2005

(54) GOLF TEE

(76) Inventor: Dong-Yi Syu, 9F-6, No. 7, Lane 677, Sec. 2, Yongda Rd., Yongkang City, Tainan County (TW)

( * ) Notice: Subject to any disclaimer, the term of this patent is extended or adjusted under 35 U.S.C. 154(b) by 167 days.

(21) Appl. No.: 10/743,775

(22) Filed: Dec. 24, 2003

(65) Prior Publication Data

US 2005/0143195 A1 Jun. 30, 2005

(51) Int. Cl.[7] ..... A63B 57/00
(52) U.S. Cl. ..... 473/400; 473/401
(58) Field of Search ..... 473/386–403

(56) References Cited

U.S. PATENT DOCUMENTS 4,516,780 A * 5/1985 Tabet ..... 473/396
4,786,054 A * 11/1988 Keys ..... 473/396
4,893,616 A * 1/1990 Liccardello ..... 473/396
5,085,431 A * 2/1992 McGuire ..... 473/398
5,242,170 A * 9/1993 Ward ..... 473/396
6,083,121 A * 7/2000 Hovey ..... 473/396
6,682,443 B1 * 1/2004 Liu ..... 473/387

* cited by examiner

*Primary Examiner*—Steven Wong
(74) *Attorney, Agent, or Firm*—Rosenberg, Klein & Lee

(57) ABSTRACT

A golf tee includes an insertion part for insertion into a ground, a supporting tube for holding a golf ball up, and a connecting tube for connecting the supporting tube to the insertion part with; the supporting tube has an annular protrusion near a bottom on an inner side; the connecting tube has several elongated gaps, which extend longitudinally from a top to a lower portion to divide an outer side of the tube into separate sections; the connecting tube has several detaining bumps on each separate section, and is secured to a top of the insertion part at a lower end; the supporting tube is positioned around the connecting tube such that the annular protrusion is detained by the detaining bumps of the connecting tube, and such that it is displaceable relative to the connecting tube for adjustment of height after the annular protrusion is released from the bumps.

5 Claims, 5 Drawing Sheets

GOLF TEE

BACKGROUND OF THE INVENTION

1. Field of the Invention

The present invention relates to a golf tee, more particularly one, which is comprised of flexible parts so as not to be easily damaged, fluorescent-colored, and adjustable in height to suit the user's need.

2. Brief Description of the Prior Art

Tees are used to hold golf balls a small distance above a teeing ground of a golf course for preventing the club heads from hitting the ground to get damaged or slowed down when the golf players are teeing off the golf balls hard with the clubs.

Referring to FIG. 1, a conventional golf tee 1, which is made of hard plastic materials, includes a hollow insertion portion 11, and a hollow holding portion 12 joined to an upper end of the insertion portion 11. The insertion portion 11 has a cone-shape at a lower end to be easily inserted in the ground while the holding portion 12 has an upper opening, over which a golf ball can be stably positioned.

The above golf tee has some disadvantages, and is not very convenient to use because of the followings reasons:

1. In case the height of the tee turns out to be unsuitable after the insertion portion 11 of the tee is inserted into the ground, the golf player has to relocate the tee, and try to insert the insertion portion 11 into the ground at an appropriate depth with carefulness.

2. Because the tee is made of hard plastic materials, the head of a club is prone to have scratches formed thereon by hitting the tee, which scratches will change the performance of a player for the worse in teeing off a golf ball with the club.

3. Because the tee is made of hard plastic materials, it is likely to get damaged when being hit by the head of a club.

SUMMARY OF THE INVENTION

It is a main object of the present invention to provide a golf tee to overcome the above disadvantages.

The golf tee of the present invention includes an insertion part for insertion into a ground, a supporting tube for holding a golf ball up, and a connecting tube for connecting the supporting tube to the insertion part with. The supporting tube has an annular protrusion on an inner side of a lower portion. The connecting tube has several elongated gaps, which extend longitudinally from a top to a lower portion of the tube to divide an outer side of the tube into separate sections. The connecting tube further has several spaced detaining bumps on each of the separate sections. The connecting tube is secured to a top of the insertion part at a lower end thereof. The supporting tube is positioned around the connecting tube such that the annular protrusion thereof is releaseably detained by the spaced detaining bumps of the connecting tube, and such that it is displaceable relative to the connecting tube for adjustment of height after the annular protrusion is released from the detaining bumps.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
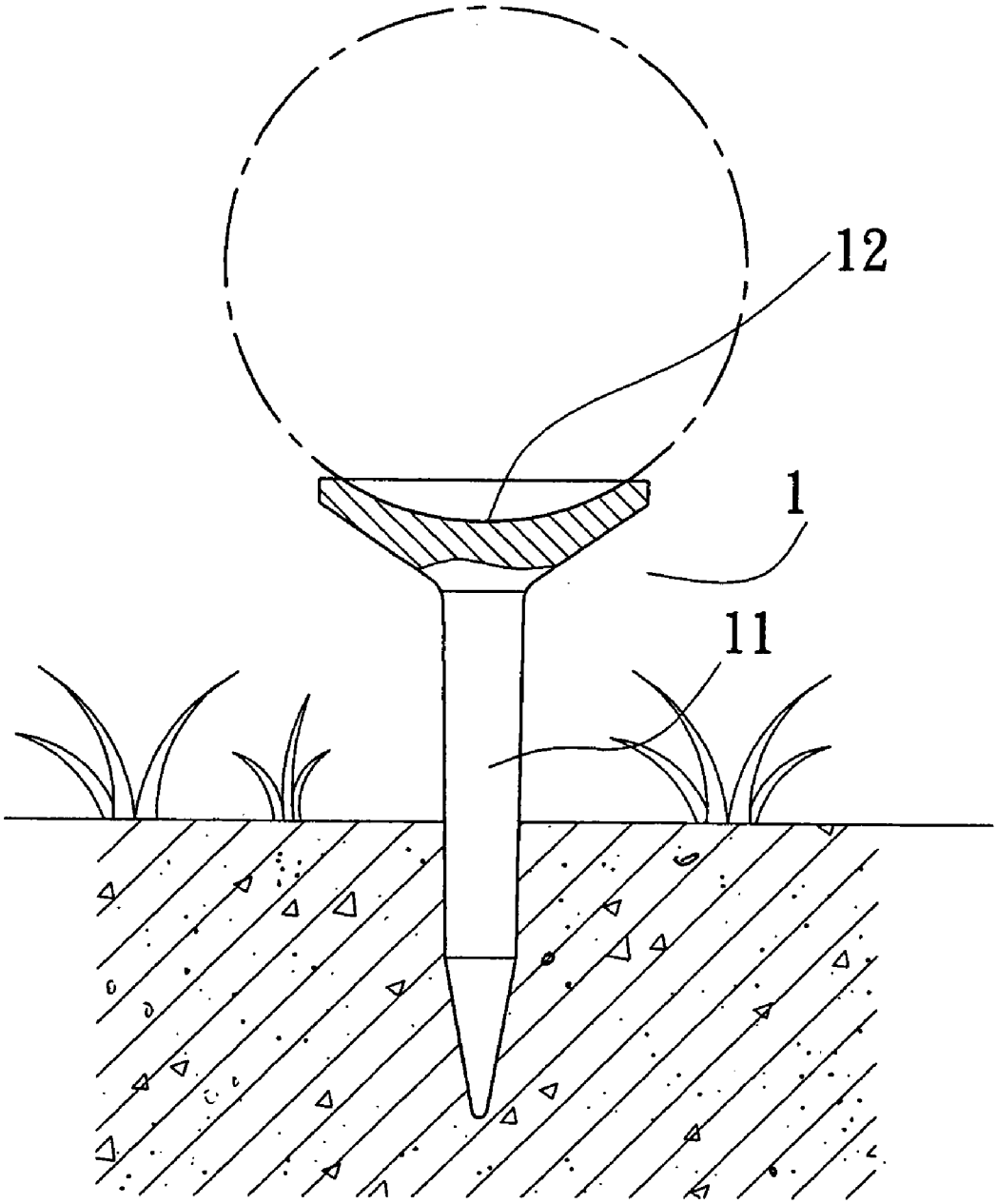
F I G. 1 (PRIOR ART)
FIG. 1 is a front view of the conventional golf tee in use.
Figure 2:
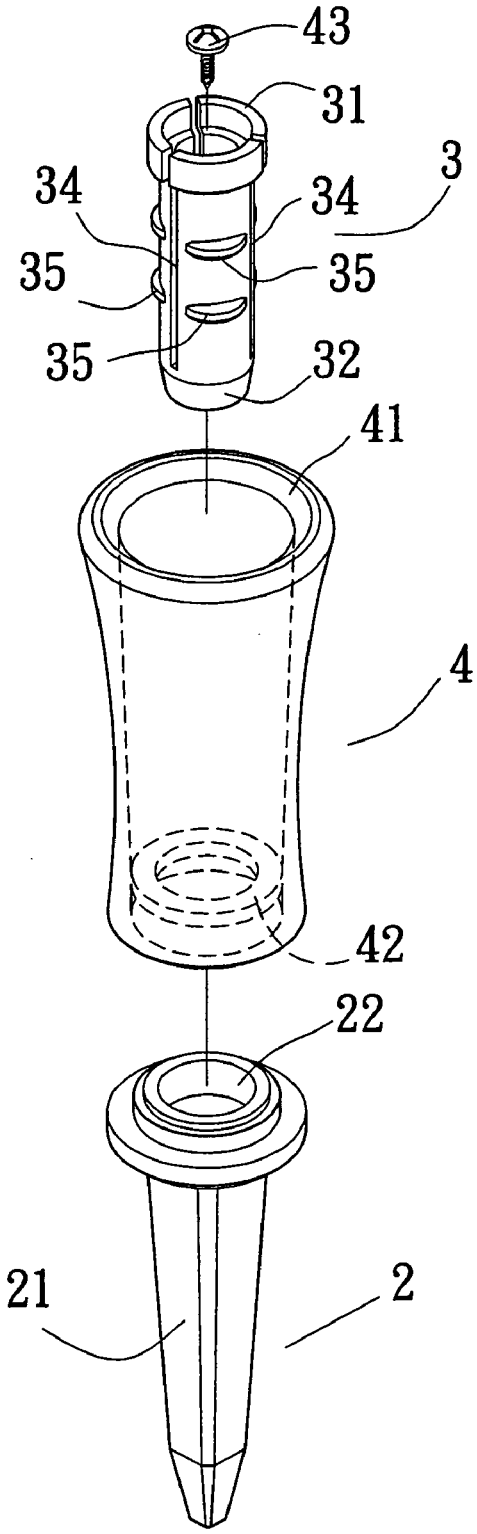
FIG. 2 is an exploded perspective view of the golf tee according to the present invention.
Figure 3:
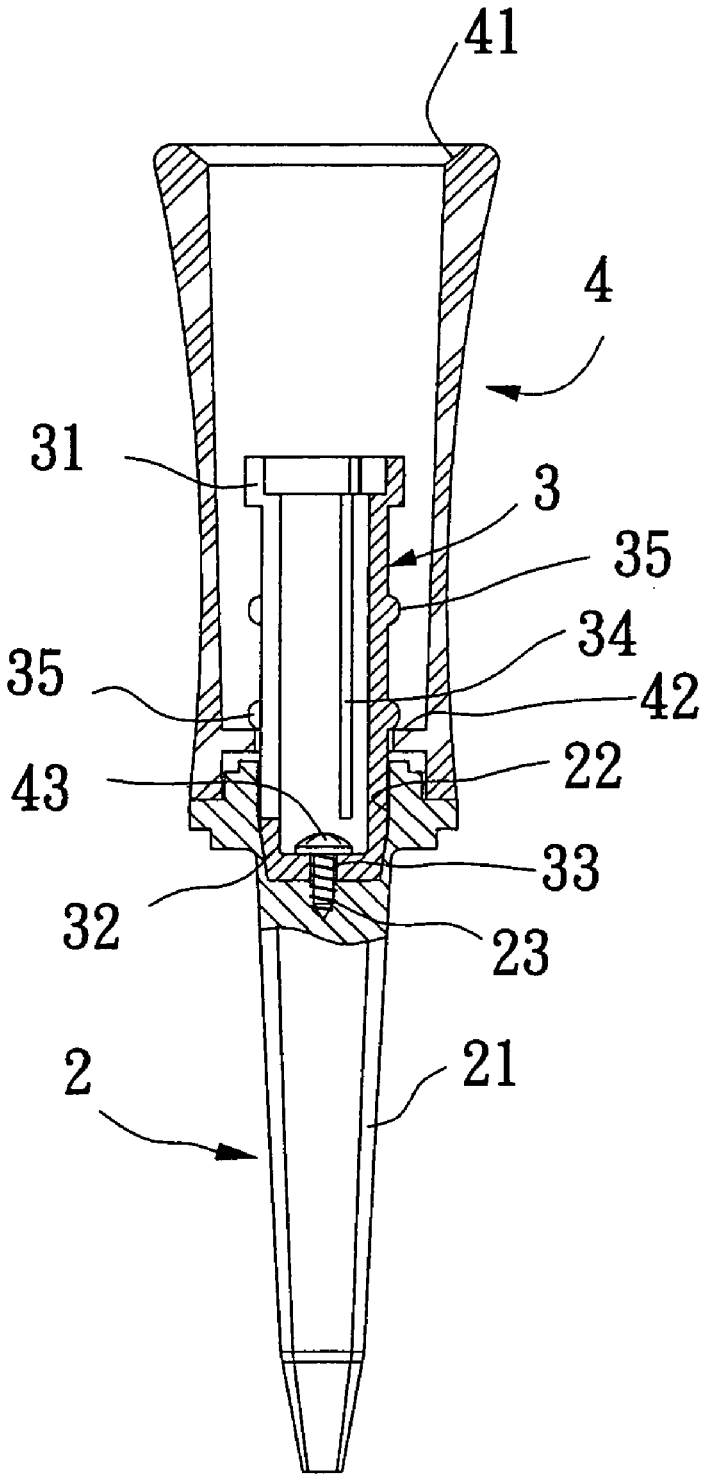
FIG. 3 is a vertical section of the golf tee according to the present invention.

Referring to FIGS. 2 and 3, a preferred embodiment of a golf tee in the present invention includes an insertion part 2 for insertion into the ground, a supporting tube 4 for holding a golf ball thereon, and a connecting tube 3 used for connecting the supporting tube 4 to the insertion part 2.

The insertion part 2 is made of hard plastic materials, and has an awl-shaped, insertion portion 21, and an upper end on top of the insertion portion 21, which upper end is formed with a cavity 22, and a fitting hole 23 (FIG. 3).

The supporting tube 4 is made of soft plastic materials, and has an annular engaging protrusion 42 on an inner side of a lower portion thereof, and an annular supporting portion 41 on an upper end, which has a larger inner diameter than the other sections of the tube 4.

The connecting tube 3 is made of soft materials, and has a detaining rim 31 at an upper end, a through hole 33 on a bottom, and an insertion portion 32 at a lower end, which is shaped like a cone without pointed end. The detaining rim 31 has a larger diameter than the other portion of the tube 3. The connecting tube 3 is further formed with several spaced elongated gaps 34, by which an outer side of the tube 3 is divided into separate sections, and detaining bumps 35 on the separate sections of the outer side thereof. Thus, the connecting tube 3 will get thinner when lateral external forces are being exerted around it. The elongated gaps 34 extend longitudinally from the upper end of the tube 3 to a lower portion near the insertion portion 32. The tube 3 is inserted in, and displaceable relative to the supporting tube 4.

The detaining bumps 35 of the connecting tube 3 are formed in such a way that when there are lateral forces being exerted around the tube 3 to thin the same, the bumps 35 can be passed beyond the annular engaging protrusion 42 of the supporting tube 4. Otherwise the detaining bumps 35 can't be passed beyond the engaging protrusion 42.

In assembling the tee, first the tube 4 is fitted around the upper end of the insertion part 2 at the lower end, and the tube 3 is inserted into the tube 4, and fitted in the cavity 22 at the lower insertion portion 32 thereof; thus, lowermost ones of the detaining bumps 35 are right above the annular protrusion 42, as shown in FIG. 3. Then, a connecting element 43 is secured in the through hole 33 and the fitting hole 23 for securing the tube 3 to the insertion part 2.

Figure 5:
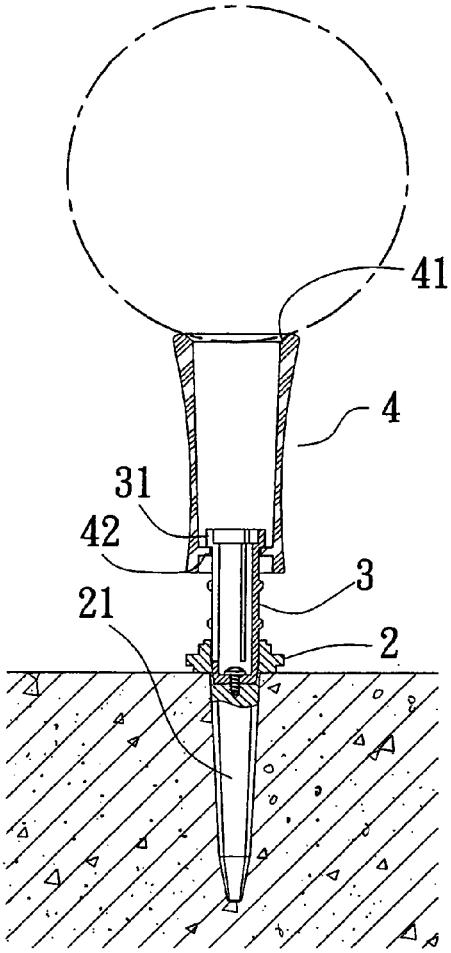
FIG. 5 is a vertical section of the golf tee of the present invention, under adjustment.
Figure 4:
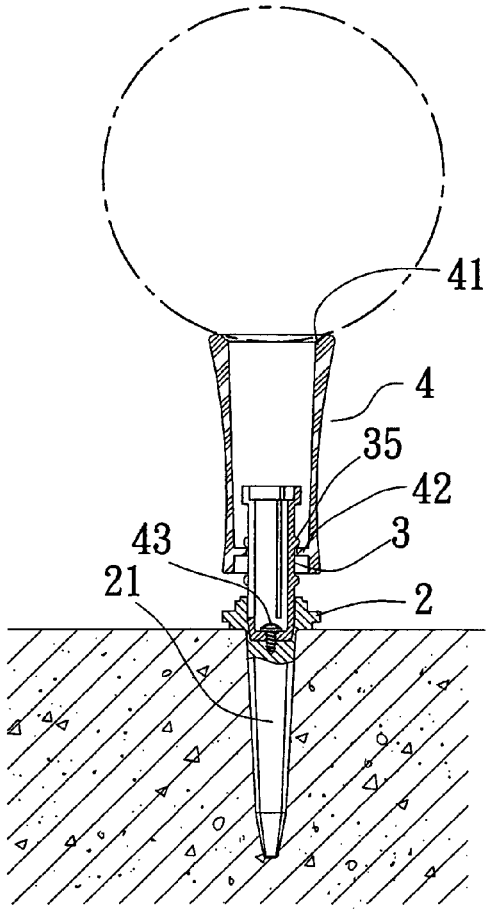
FIG. 4 is a vertical section of the golf tee of the present invention.
Figure 6:
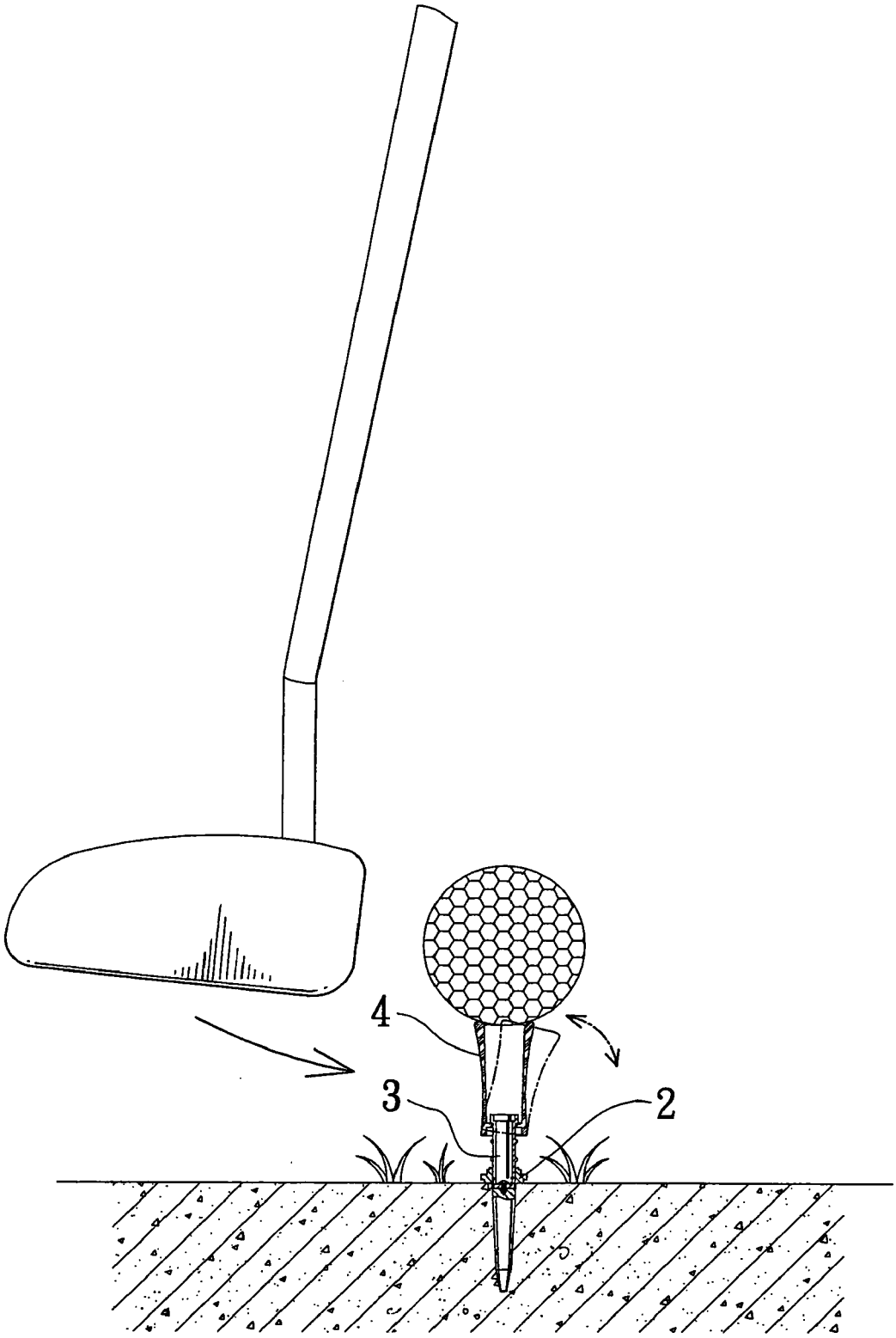
FIG. 6 is a view showing the motion of the golf tee of the present invention while a club is hitting a ball on the tee, and touching the tee.

To use the tee, first the awl-shaped portion 21 of the insertion part 2 is completely inserted into the ground. Then, the supporting tube 4 is adjusted in height according to the player's need by means of displacing the supporting tube 4 relative to the connecting tube 3 after lateral forces have been applied on the tubes 4 and 3 to deform the same to such a degree that the annular protrusion 42 can be moved beyond the detaining bumps 35; after the supporting tube 4 is moved to a suitable height, the user is to release the tubes 4 and 3 so that the tubes 4 and 3 regain their shape for allowing the detaining bumps 35 to detain the annular engaging protrusion 42 to prevent the supporting tube 4 from changing height, as shown in FIGS. 4 and 5. Then, the player puts a golf ball on the supporting tube 4. Referring to FIG. 6, in case the club head hits the supporting tube 4 while the player is teeing off, the supporting tube 4 will change position accordingly owing to the flexibility thereof as well as the flexibility of the tube 3. Consequently, there is no chance that the club head has scratches formed thereon or the tee gets damaged when the club head hits the supporting tube 4 in teeing off.

Once the player has adjusted the tee to the length that suits him, he only has to insert the awl-shaped insertion portion 21 completely into the ground to position the tee at the same height, not having to adjust the length of the tee again afterwards.

In addition, the insertion part 2, and the tubes 3 and 4 can be fluorescent-colored so that the tee can be clearly seen when it is used during the night or in the dark.

From the above description, it can be easily understood that the golf tee of the present invention has the following advantages over the conventional one:

1. In case the height of the tee is not suitable for a user after awl-shaped insertion portion 21 has been inserted into the ground, the user only has to adjust the position of the supporting tube 4, not having to relocate the whole tee. Therefore, the tee is convenient to use.

2. The supporting tube 4 can be easily made to become displaceable relative to the connecting tube 3 by means of applying lateral forces on the tubes 4 and 3 to deform the same.

3. If the club head hits the supporting tube 4 while the player is teeing off, the tube 4 will change position accordingly because it and the tube 3 are flexible. Therefore, there is smaller chance that the club head has scratches formed thereon or the tee gets damaged.

4. The tee can be clearly seen when it is used during the night or in the dark because the insertion part 2, and the tubes 3 and 4 are fluorescent-colored.

What is claimed is:

1. A golf tee, comprising an insertion part having a lower end portion for insertion into a ground;

a supporting tube for holding a golf ball up; the supporting tube having an annular engaging protrusion on an inner side of a lower portion thereof; the supporting tube having an annular supporting portion on an upper end thereof for supporting a golf ball thereon; and a connecting tube for connecting the supporting tube to the insertion part with; the connecting tube having a plurality of elongated gaps longitudinally extending from a top to a lower portion thereof, and dividing an outer side of the connecting tube into separate sections; the connecting tube having a plurality of spaced detaining bumps on each of the separate sections; the connecting tube being secured to a top of the insertion part at a lower end thereof;

the supporting tube being positioned around the connecting tube such that the annular protrusion thereof is releaseably detained by the spaced detaining bumps on the outer side of the connecting tube, thus being displaceable relative to the connecting tube for adjustment of height after the annular protrusion is released from the detaining bumps.

2. The golf tee as claimed in claim 1, wherein the insertion part has a cavity on the top thereof, and the connecting tube has an insertion portion at the lower end thereof, which is inserted in the cavity of the insertion part.

3. The golf tee as claimed in claim 2, wherein the top of the insertion part has a fitting hole thereon, and the lower end of the connecting tube has a through hole aligned with the fitting hole; a connecting element being passed through, and secured in both the through hole and the fitting hole.

4. The golf tee as claimed in claim 1, wherein the insertion part has a fitting hole on the top thereof, and the connecting tube has a through hole aligned with the fitting hole on the lower end thereof; a connecting element being passed through, and secured in both the through hole and the fitting hole.

5. The golf tee as claimed in claim 1, wherein the annular supporting portion of the upper end of the supporting tube has a larger inner diameter than other portions of the supporting tube.

* * * * *